United States Patent [19]

Rudashevsky et al.

[11] Patent Number: 4,788,968

[45] Date of Patent: Dec. 6, 1988

[54] ELECTROMAGNETIC VIBRATOR

[75] Inventors: German E. Rudashevsky; Alexandr G. Krichevsky; Olga G. Blokhina; Alexandr S. Mirkin, all of Moscow, U.S.S.R.

[73] Assignee: Institute Mashinovedeniya imeni Blagonravova A.A. AN USSR, Moscow, U.S.S.R.

[21] Appl. No.: 41,145

[22] PCT Filed: Jun. 20, 1986

[86] PCT No.: PCT/SU86/00058

§ 371 Date: Mar. 11, 1987

§ 102(e) Date: Mar. 11, 1987

[87] PCT Pub. No.: WO87/00426

PCT Pub. Date: Jan. 29, 1987

[30] Foreign Application Priority Data

Jul. 24, 1985 [SU] U.S.S.R. ..... 3938113

[51] Int. Cl.[4] ..... A61H 1/00

[52] U.S. Cl. ..... 128/41; 128/52; 128/55; 310/30; 318/114

[58] Field of Search ..... 128/41, 42, 43, 51–55; 310/15, 17, 22, 24, 30; 318/119, 114

[56] References Cited

U.S. PATENT DOCUMENTS

| | | | |
|---|---|---|---|
| 2,766,750 | 10/1956 | Darcissac | 128/41 |
| 3,065,366 | 11/1962 | Speiser et al. | 310/15 |
| 3,096,758 | 7/1963 | Savage | 128/41 |
| 3,129,347 | 4/1964 | Tognola | 310/15 |
| 3,503,395 | 3/1970 | Meyer . | |
| 3,984,708 | 10/1976 | Holmlund et al. | 128/41 |
| 4,069,816 | 1/1978 | Yamamura et al. | 128/41 |
| 4,549,535 | 10/1985 | Wing | 128/41 |

FOREIGN PATENT DOCUMENTS

| | | | |
|---|---|---|---|
| 2614641 | 1/1980 | Fed. Rep. of Germany . | |
| 1046822 | 10/1966 | United Kingdom . | |
| 1425983 | 2/1976 | United Kingdom | 128/41 |
| 1548917 | 7/1979 | United Kingdom . | |

OTHER PUBLICATIONS

"Electromechanical Transducer for Vibrotactile Stimulation", R. C. Bice . . . pp. 856–857.

Yu, V. Shneider, V. S. Golovin, Vibrator dlia Peredachi . . . Issue 22, Moscow, 1969, pp. 245–249.

*Primary Examiner*—Edgar S. Burr

*Assistant Examiner*—Huong Q. Pham

*Attorney, Agent, or Firm*—Burgess, Ryan & Wayne

[57] ABSTRACT

Disclosure is made of an electromagnetic vibrator comprising a housing (1) having a cover (6), which accommodates a striker (2) and an excitation coil (3) producing an alternating magnetic field which makes the striker (2) reciprocate along the geometrical axis of the excitation coil (3), the striker (2) being arranged freely in the housing (1) and comprising a permanent magnet (4) having an end surface in a plane parallel to a base (5) of the excitation coil (3) which is located, when the magnetic field of the excitation coil (3) and the magnetic field of the permanent magnet (4) are interacting, at a distance from the base (5) of the excitation coil (3), which is equal to 0.6–0.7 of the height of the excitation coil (3).

2 Claims, 1 Drawing Sheet

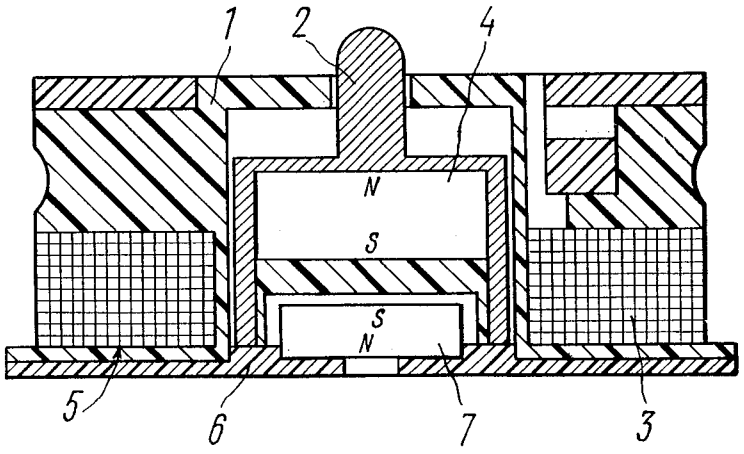
1
2
4
N
S
S
N
3
7
6
5

ELECTROMAGNETIC VIBRATOR

TECHNICAL FIELD

This invention relates to satisfying vital human necessities, to devices stimulating reflex points on the body surface and, in particular, to electromagnetic vibrators.

BACKGROUND ART

Known in the art is a large variety of devices used to stimulate reflex points of human body. The closest prior art, both in the principle of action and in requirements set to such devices, are vibrators equipped with electromagnetic and electrodynamic systems.

Known in the art is a vibrator (R. C. Bice, Electromechanical Transducer for Vibrotactile Stimulation, the Review of Scientific Instruments, Vol. 32, No. 7, 1961, pp. 856–857) comprising a housing accommodating an excitation coil and a membrane having a load attached thereto.

Since a loaded membrane has a lot of inertia, the housing accommodating the magnetic system becomes a vibrating element. But the Bice vibrator is deficient in that the amplitude of mechanical oscillations produced thereby is frequency-dependent and can reach a maximum of 145 Hz. This is insufficient to stimulate by vibrations human mechanoreceptors. In addition, the vibrator is large, its diameter is 23 mm and its height is 33 mm. The vibrator is relatively heavy, its weight is 47.5 g. It is not easy or even impossible, to secure the vibrator in, for example, the prosthesis sleeve.

Known in the art is a vibrator (Yu. V. Shneider, V. S. Golovin, Vibrator dilia Peredachi Vibratsionnykh Razdrazheny, Sbornik trudov Instituta protezirovania i protezostroenia, Issue 22, Moscow, 1969, pp. 245–249), comprising a housing accommodating an excitation coil. A permanent magnet is installed in the coil and connected to the housing through a set of resilient plates. Interaction of the magnetic fields of the excitation coil and the permanent magnet subject the magnet, acting as a striker, to the torque forcing the permanent magnet to change its initial position. The permanent magnet comes into contact with the skin surface of a biological object through an opening in the housing and in this manner stimulates mechanoreceptors of the biological object.

The amplitude-frequency characteristic of this vibrator is linear within a range of from 0 to 50 Hz. When the frequency exceeds 50 Hz, the oscillation frequency goes down and comes close to zero in the region of 100 Hz. This vibrator is also deficient in that it is made rectangular, 32 by 20 mm in size and weighs 70 grams. This is inconvenient for devices used to stimulate reflex points.

It becomes clear from the above data that prior art vibrators cannot transmit pulsed signals, their vibration amplitude and strike force are insufficient.

Also known in the art is an electromagnetic vibrator (Yu. V. Shneider, V. S. Golovin, Vibrator dlia Peredachi Vibratsionnykh Razdrazheny, Sbornik trudov Instituta protezirovaniya i protezostroyeniya, Issue 22, Moscow, 1969, pp. 245–249) comprising a housing with a cover and an excitation coil arranged on the housing and equipped with a ferromagnetic striking member and a spring. Input signals produce a magnetic field around the coil. This magnetic field is capable to overcome the resistance of the spring to pull in the striker inside the coil. When the input signal discontinues, the striker is pushed by the spring from the coil and strikes the skin.

The diameter of the vibrator is 29 mm, the height 17.2 mm, its weight is 50 g. But this vibrator is deficient in that the spring restricts the frequency characteristic of the vibrator to the range of 50 Hz. The vibrator, moreover, is insufficiently reliable when operated for long periods. The size of the vibrator is also a limitation to many types of practical problems.

DISCLOSURE OF THE INVENTION

This invention is to provide an electromagnetic vibrator whose design ensures maximum force of stimulation of mechanoreceptors within a range of 0–250 Hz and with an amplitude of 1 mm, the weight and size of the vibrator being brought down to a minimum, while retaining its reliability during lengthy operational periods.

This is achieved in that in an electromagnetic vibrator comprising a housing with a cover, which accommodates a striker and an excitation coil producing an alternating magnetic field which makes the striker reciprocate along the geometrical axis of the excitation coil, according to the invention, the striker is freely arranged in the housing and comprises a permanent magnet having an end surface in a plane parallel to a base of the excitation coil which is located, when the magnetic field of the excitation coil is interacting with the magnetic field of the permanent magnet, at a distance from the base of the excitation coil, which is equal to 0.6–0.7 of the height of the excitation coil.

Advisably, a second permanent magnet should be secured in the cover of the electromagnetic vibrator in order to interact with the permanent magnet of the striker and produce a magnetic field directed along the axis of the striker in opposition to the magnetic field of the permanent magnet of the striker.

The striker moves freely inside the excitation coil and its permanent magnet is secured therein so that the end surface of the permanent magnet is located at a distance in relation to the base of the excitation coil, which is equal to 0.6–0.7 of the coil height. The striker arranged in this way produces an adequate force and, respectively, effect on the mechanoreceptors within a required range. Moreover, this force is supplemented by the so-called "magnetic spring" realized by the stationary permament magnet installed in the cover of the vibrator housing. The magnetic field of this permanent magnet is directed along the striker axis in opposition to the magnetic field of the permanent magnet of the striker. Interaction of these magnets during the operational cycle of the electromagnetic vibrator is a perfect simulation of the function of a helical spring, which is a substantial contribution to faultless lengthy operation of the vibrator.

BRIEF DESCRIPTION OF ACCOMPANYING DRAWINGS

The invention will now be described in greater detail with reference to a specific embodiment thereof and an accompanying drawing showing a sectional view of an electromagnetic vibrator according to the invention.

BEST MODE FOR CARRYING OUT THE INVENTION

An electromagnetic vibrator, shown in the drawing, comprises a housing 1 wherein a striker 2 is freely arranged and accommodates an excitation coil 3. A permanent magnet 4 is secured to the striker 2 and has an end surface in a plane parallel to a base 5 of the excitation coil 3 which located at a distance with respect to the base 5 of the excitation coil 3, which amounts to 0.6–0.7 of the height of the coil 3. A cover 6 is secured on the housing 1 and carries a second permanent magnet 7. Leads of the excitation coil 3 are not shown in the drawing.

The electromagnetic vibrator according to the invention operates as follows.

When the electromagnetic vibrator is connected to an AC circuit, the excitation coil 3 produces an alternating magnetic field and this magnetic field makes the striker 2 reciprocate along the geometrical axis of the excitation coil 3.

When current flows in the excitation coil 3 and when the direction of the magnetic flux of the excitation coil 3 coincides with that of the permanent magnet 4 of the striker 2, the striker 2 is pulled into the excitation coil 3 with a force proportional to the sum of gradients of their fluxes minus the gradient of the flux of the stationary permanent magnet 7. The permanent magnet 4 of the striker 2 stops short of the base 5 of the excitation coil 3 at a distance equal to 0.6–0.7 of the height of this coil 3. When the direction of current in the excitation coil 3 is reversed, the striker is pushed out of the coil 3 in the direction of the object with a force proportional to the sum of gradients of the fluxes of the permanent magnet 4 of the striker 2, of the stationary permanent magnet 7, and of the excitation coil 3. The above distance from the permanent magnet 4 to the base 5 of the excitation coil 3, which is equal to 0.6–0.7 of the height of the coil 3, has been obtained experimentally and corresponds to the peak strike force of the striker 2. If the distance exceeds 0.7 of the coil height, the strike force becomes less because the sum of gradients of the magnetic field goes down. If the distance becomes less than 0.6 of the height of the coil 3, the invention cannot be realized in the size proposed herein. To summarize, the stationary permanent magnet 7 combined with the-permanent magnet 4 of the striker 2 perform the function of a "magnetic spring" compressed when the striker 2 is pulled into the excitation coil 3 and pushing the striker 2 from the excitation coil 3 when the current is reversed therein.

The electromagnetic vibrator according to the invention produces a greater, as compared to prior art devices, striking force as related to its volume, which is about 30 g/cm$^3$. This electromagnetic vibrator has a diameter of 22 mm and a height of 10 mm, and weighs only 12 g. The amplitude of vibrations of the striker 2 is within the required range of 0–250 Hz. This electromagnetic vibrator contains no springs or resilient members and, therefore, is reliable even during lengthy periods of operation.

INDUSTRIAL APPLICABILITY

The electromagnetic vibrator proposed herein can be used for preventive or rehabilitation measures in cases of disturbances of motor functions of lower extremeties and vestibular apparatus by excitation of mechanoreceptors in the skin of supporting zones of feet in accordance with the time and power parameters of the natural locomotive human actions. In addition, this electromagnetic vibrator can be used to transmit information on prosthesis parameters, primarily on the gripping force. The electromagnetic vibrator can also be used for vibrotesting human skin.

What is claimed is:

1. An electromagnetic vibrator comprising:

a housing having a cover;

a striker mounted within said housing for reciprocable movement therein; and an excitation coil fixedly mounted in said housing, said excitation coil having a base and a central, longitudinal axis and said excitation coil producing an alternating magnetic field to cause the striker to reciprocate along the central, longitudinal axis of the excitation coil;

the improvement being that:

the striker is arranged to freely reciprocate within the housing and includes a permanent magnet having an end surface in a plane parallel to said base of said excitation coil, said end surface being located at a distance within the range of 0.6 to 0.7 of the height of the excitation coil with respect to said base of the excitation coil.

2. An electromagnetic vibrator comprising:

a housing having a cover;

a striker mounted within said housing for reciprocable movement therein; and an excitation coil fixedly mounted in said housing, said excitation coil having a base and a central, longitudinal axis and said excitation coil producing an alternating magnetic field to cause the striker to reciprocate along the central, longitudinal axis of the excitation coil;

the improvement being that:

the striker is arranged to freely reciprocate within the housing and includes a permanent magnet having an end surface in a plane parallel to said base of said excitation coil, said end surface being located at a distance within the range of 0.6 to 0.7 of the height of the excitation coil with respect to said base of the excitation coil; and a second permanent magnet is secured in the cover of the housing and interacts with the permanent magnet of the striker in order to produce a magnetic field directed along the axis of the striker and in opposition to the magnetic field of the permanent magnet of the striker.

* * * * *